US008584488B2

(12) United States Patent
Wilkinson et al.

(10) Patent No.: US 8,584,488 B2
(45) Date of Patent: Nov. 19, 2013

(54) LIQUEFIED NATURAL GAS PRODUCTION

(75) Inventors: John D. Wilkinson, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 1158 days.

(21) Appl. No.: 12/479,061

(22) Filed: Jun. 5, 2009

(65) Prior Publication Data

US 2011/0120183 A9 May 26, 2011

Related U.S. Application Data

(60) Provisional application No. 61/086,702, filed on Aug. 6, 2008.

(51) Int. Cl.
*F25J 3/00* (2006.01)

(52) U.S. Cl.
USPC ..... 62/620; 62/618; 62/619

(58) Field of Classification Search
USPC ..... 62/618, 619, 620, 621, 630, 631
See application file for complete search history.

(56) References Cited

U.S. PATENT DOCUMENTS

| | | | | |
|---|---|---|---|---|
| 33,408 | A | 10/1861 | Turner et al. | 68/22 R |
| 2,952,984 | A | 9/1960 | Marshall, Jr. | 62/622 |
| 3,292,380 | A | 12/1966 | Bucklin | 62/621 |
| 3,837,172 | A | 9/1974 | Markbreiter et al. | 62/621 |
| 4,061,481 | A | 12/1977 | Campbell et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard | 62/634 |
| 4,251,249 | A | 2/1981 | Gulsby | 62/621 |
| 4,278,457 | A | 7/1981 | Campbell et al. | 62/621 |
| 4,519,824 | A | 5/1985 | Huebel | 62/621 |
| 4,617,039 | A | 10/1986 | Buck | 62/621 |

(Continued)

OTHER PUBLICATIONS

Adrian J. Finn et al., "LNG technology for Offshore and Mid-Scale Plants", Proceedings of the Seventy-Ninth Annual Convention of the Gas Processors Association, pp. 429-450.

(Continued)

*Primary Examiner* — Frantz Jules
*Assistant Examiner* — Webeshet Mengesha
(74) *Attorney, Agent, or Firm* — Fitzpatrick, Cella, Harper & Scinto

(57) ABSTRACT

A process and an apparatus for liquefying a portion of a natural gas stream are disclosed. The natural gas stream is cooled under pressure and divided into a first stream and a second stream. The first stream is cooled, expanded to an intermediate pressure, and supplied to a lower feed point on a distillation column. The second stream is expanded to the intermediate pressure and divided into two portions. One portion is cooled and then supplied to a mid-column feed point on the distillation column; the other portion is used to cool the first stream. The bottom product from this distillation column preferentially contains the majority of any hydrocarbons heavier than methane that would otherwise reduce the purity of the liquefied natural gas, so that the overhead vapor from the distillation column contains essentially only methane and lighter components. This overhead vapor is cooled and condensed, and a portion of the condensed stream is supplied to a top feed point on the distillation column to serve as reflux. A second portion of the condensed stream is expanded to low pressure to form the liquefied natural gas stream.

12 Claims, 2 Drawing Sheets

(56) References Cited

U.S. PATENT DOCUMENTS

Figure 1:
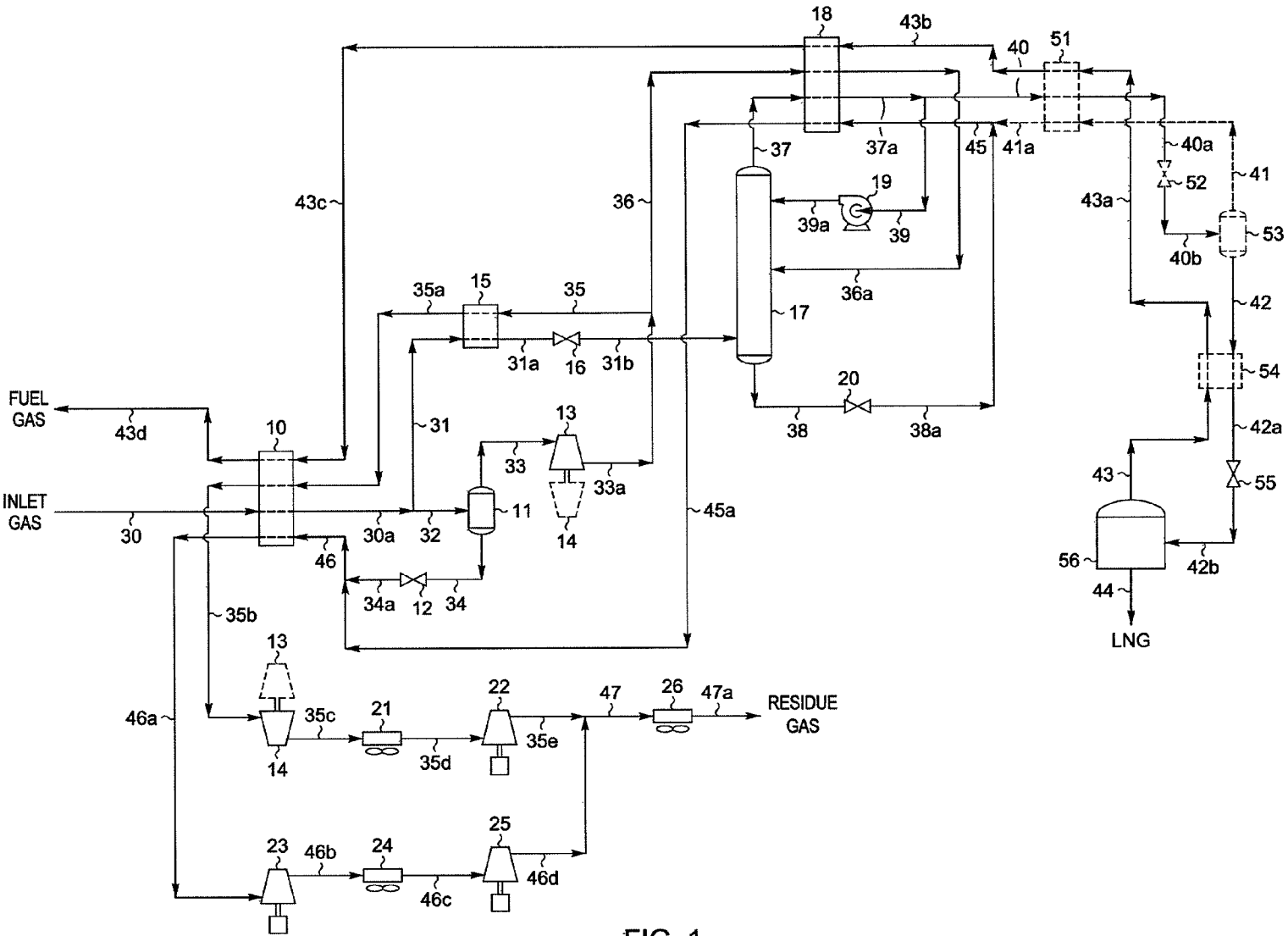

| | | | | |
|---|---|---|---|---|
| 4,687,499 | A | 8/1987 | Aghili | 62/621 |
| 4,689,063 | A | 8/1987 | Paradowski et al. | 62/621 |
| 4,690,702 | A | 9/1987 | Paradowski et al. | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 5,275,005 | A | 1/1994 | Campbell et al. | 62/621 |
| 5,363,655 | A | 11/1994 | Kikkawa et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,771,712 | A | 6/1998 | Campbell et al. | 62/621 |
| 5,799,507 | A | 9/1998 | Wilkinson et al. | 62/621 |
| 5,881,569 | A * | 3/1999 | Campbell et al. | 62/621 |
| 5,890,378 | A * | 4/1999 | Rambo et al. | 62/621 |
| 5,983,664 | A | 11/1999 | Campbell et al. | 62/621 |
| 6,182,469 | B1 | 2/2001 | Campbell et al. | 62/621 |
| 6,578,379 | B2 | 6/2003 | Paradowski | 62/622 |
| 6,604,380 | B1 | 8/2003 | Reddick et al. | 62/620 |
| 6,712,880 | B2 | 3/2004 | Foglietta et al. | 95/184 |
| 6,889,523 | B2 | 5/2005 | Wilkinson et al. | 62/613 |
| 6,907,752 | B2 | 6/2005 | Schroeder et al. | 62/620 |
| 6,915,662 | B2 | 7/2005 | Wilkinson et al. | 62/621 |
| 6,941,771 | B2 | 9/2005 | Reddick et al. | 62/620 |
| 7,069,743 | B2 | 7/2006 | Prim | 62/620 |
| 7,155,931 | B2 | 1/2007 | Wilkinson et al. | 62/620 |
| 7,191,617 | B2 | 3/2007 | Cuellar et al. | 62/628 |
| 7,204,100 | B2 | 4/2007 | Wilkinson et al. | 62/612 |
| 7,216,507 | B2 | 5/2007 | Cuellar et al. | 62/620 |
| 7,219,513 | B1 | 5/2007 | Mostafa | 62/620 |
| 7,631,516 | B2 | 12/2009 | Cuellar et al. | 62/620 |
| 2004/0079107 | A1 * | 4/2004 | Wilkinson et al. | 62/611 |
| 2004/0177646 | A1 * | 9/2004 | Wilkinson et al. | 62/614 |
| 2006/0000234 | A1 | 1/2006 | Cuellar et al. | 62/620 |
| 2006/0283207 | A1 | 12/2006 | Pitman et al. | 62/620 |
| 2008/0078205 | A1 | 4/2008 | Cuellar et al. | 62/620 |
| 2008/0190136 | A1 | 8/2008 | Pitman et al. | 62/620 |
| 2008/0282731 | A1 | 11/2008 | Cuellar et al. | 62/620 |
| 2009/0100862 | A1 | 4/2009 | Wilkinson et al. | 62/620 |

OTHER PUBLICATIONS

PCT Notification of Transmittal of the International Search Report and The Written Opinion of the International Searching Authority, or the Declaration (Form PCT/ISA/220); PCT International Search Report (Form PCT/ISA/210); PCT Written Opinion of The International Searching Authority (Form PCT/ISA/237), Sep. 17, 2009.

* cited by examiner

LIQUEFIED NATURAL GAS PRODUCTION

This invention relates to a process and apparatus for processing natural gas to produce liquefied natural gas (LNG) that has a high methane purity. In particular, this invention is well suited to production of LNG from natural gas found in high-pressure gas transmission pipelines. The applicants claim the benefits under Title 35, United States Code, Section 119(e) of prior U.S. Provisional Application No. 61/086,702 which was filed on Aug. 6, 2008.

BACKGROUND OF THE INVENTION

Natural gas is typically recovered from wells drilled into underground reservoirs. It usually has a major proportion of methane, i.e., methane comprises at least 50 mole percent of the gas. Depending on the particular underground reservoir, the natural gas also contains relatively lesser amounts of heavier hydrocarbons such as ethane, propane, butanes, pentanes and the like, as well as water, hydrogen, nitrogen, carbon dioxide, and other gases.

Most natural gas is handled in gaseous form. The most common means for transporting natural gas from the wellhead to gas processing plants and thence to the natural gas consumers is in high-pressure gas transmission pipelines. In a number of circumstances, however, it has been found necessary and/or desirable to liquefy the natural gas either for transport or for use. In remote locations, for instance, there is often no pipeline infrastructure that would allow for convenient transportation of the natural gas to market. In such cases, the much lower specific volume of LNG relative to natural gas in the gaseous state can greatly reduce transportation costs by allowing delivery of the LNG using cargo ships and transport trucks.

Another circumstance that favors the liquefaction of natural gas is for its use as a motor vehicle fuel. In large metropolitan areas, there are fleets of buses, taxi cabs, and trucks that could be powered by LNG if there were an economical source of LNG available. Such LNG-fueled vehicles produce considerably less air pollution due to the clean-burning nature of natural gas when compared to similar vehicles powered by gasoline and diesel engines (which combust higher molecular weight hydrocarbons). In addition, if the LNG is of high purity (i.e., with a methane purity of 95 mole percent or higher), the amount of carbon dioxide (a "greenhouse gas") produced is considerably less due to the lower carbon:hydrogen ratio for methane compared to all other hydrocarbon fuels.

The present invention is generally concerned with the liquefaction of natural gas such as that found in high-pressure gas transmission pipelines. A typical analysis of a natural gas stream to be processed in accordance with this invention would be, in approximate mole percent, 89.4% methane, 5.2% ethane and other $C_2$ components, 2.1% propane and other $C_3$ components, 0.5% iso-butane, 0.7% normal butane, 0.6% pentanes plus, and 0.6% carbon dioxide, with the balance made up of nitrogen. Sulfur containing gases are also sometimes present.

There are a number of methods known for liquefying natural gas. For instance, see Finn, Adrian J., Grant L. Johnson, and Terry R. Tomlinson, "LNG Technology for Offshore and Mid-Scale Plants", Proceedings of the Seventy-Ninth Annual Convention of the Gas Processors Association, pp. 429-450, Atlanta, Ga., Mar. 13-15, 2000 for a survey of a number of such processes. U.S. Pat. Nos. 5,363,655; 5,600,969; 5,615,561; 6,526,777; and 6,889,523 also describe relevant processes. These methods generally include steps in which the natural gas is purified (by removing water and troublesome compounds such as carbon dioxide and sulfur compounds), cooled, condensed, and expanded. Cooling and condensation of the natural gas can be accomplished in many different manners. "Cascade refrigeration" employs heat exchange of the natural gas with several refrigerants having successively lower boiling points, such as propane, ethane, and methane. As an alternative, this heat exchange can be accomplished using a single refrigerant by evaporating the refrigerant at several different pressure levels. "Multi-component refrigeration" employs heat exchange of the natural gas with a single refrigerant fluid composed of several refrigerant components in lieu of multiple single-component refrigerants. Expansion of the natural gas can be accomplished both isenthalpically (using Joule-Thomson expansion, for instance) and isentropically (using a work-expansion turbine, for instance).

While any of these methods could be employed to produce vehicular grade LNG, the capital and operating costs associated with these methods have generally made the installation of such facilities uneconomical. For instance, the purification steps required to remove water, carbon dioxide, sulfur compounds, etc. from the natural gas prior to liquefaction represent considerable capital and operating costs in such facilities, as do the drivers for the refrigeration cycles employed. This has led the inventors to investigate the feasibility of producing LNG from natural gas that has already been purified and is being transported to users via high-pressure gas transmission pipelines. Such an LNG production method would eliminate the need for separate gas purification facilities. Further, such high-pressure gas transmission pipelines are often convenient to metropolitan areas where vehicular grade LNG is in demand.

In accordance with the present invention, it has been found that LNG with methane purities in excess of 99 percent can be produced from natural gas, even when the natural gas contains significant concentrations of carbon dioxide. The present invention, although applicable at lower pressures and warmer temperatures, is particularly advantageous when processing feed gases in the range of 600 to 1500 psia [4,137 to 10,342 kPa(a)] or higher.

Figure 2:
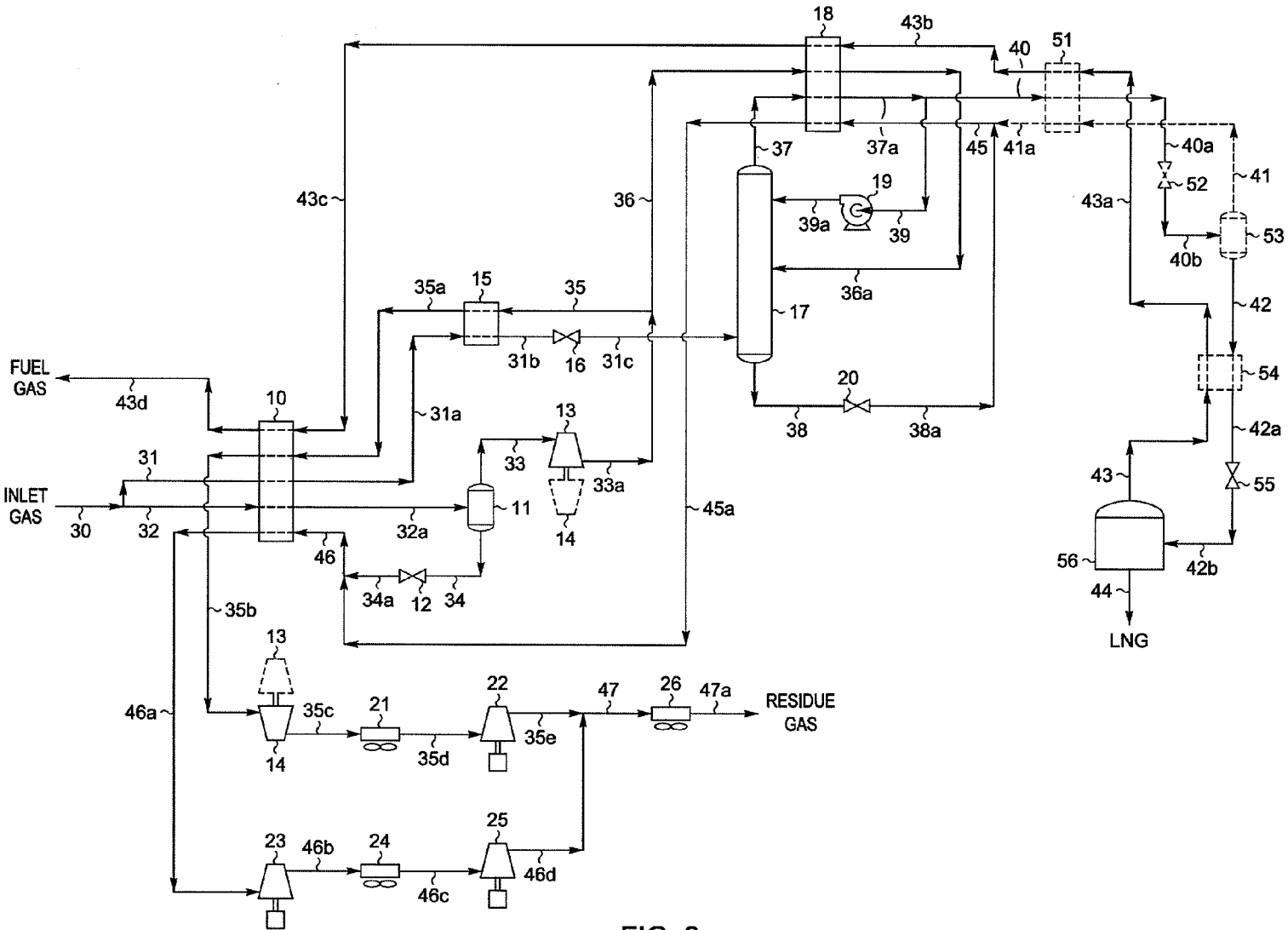

For a better understanding of the present invention, reference is made to the following examples and drawings. Referring to the drawings:

FIG. 1 is a flow diagram of an LNG production plant in accordance with the present invention; and FIG. 2 is a flow diagram illustrating an alternative means of application of the present invention to an LNG production plant.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour. The LNG production rates reported as gallons per day (gallons/D) and/or pounds per hour (Lbs/hour) correspond to the stated molar flow rates in pound moles per hour. The LNG production rates reported as cubic meters per hour ($m^3$/H) and/or kilograms per hour (kg/H) correspond to the stated molar flow rates in kilogram moles per hour.

DESCRIPTION OF THE INVENTION

FIG. 1 illustrates a flow diagram of a process in accordance with the present invention adapted to produce an LNG product with a methane purity in excess of 99%.

In the simulation of the FIG. 1 process, inlet gas taken from a natural gas transmission pipeline enters the plant at 100° F. [38° C.] and 900 psia [6,205 kPa(a)] as stream 30. Stream 30 is cooled in heat exchanger 10 by heat exchange with cool LNG flash vapor at −115° F. [−82° C.] (stream 43*c*), cool expanded vapor at −57° F. [−49° C.] (stream 35*a*), and flash vapor at −115° F. [−82° C.] (stream 46). The cooled stream 30*a* at −52° F. [−47° C.] and 897 psia [6,185 kPa(a)] is divided into two portions, streams 31 and 32. Stream 32, containing about 32% of the inlet gas, enters separator 11 where the vapor (stream 33) is separated from the condensed liquid (stream 34).

Vapor stream 33 from separator 11 enters a work expansion machine 13 in which mechanical energy is extracted from this portion of the high pressure feed. The machine 13 expands the vapor substantially isentropically to slightly above the operating pressure of LNG purification tower 17, 435 psia [2,999 kPa(a)], with the work expansion cooling the expanded stream 33*a* to a temperature of approximately −108° F. [−78° C.]. The typical commercially available expanders are capable of recovering on the order of 80-85% of the work theoretically available in an ideal isentropic expansion. The work recovered is often used to drive a centrifugal compressor (such as item 14), that can be used to compress gases or vapors, like stream 35*b* for example. The expanded and partially condensed stream 33*a* is divided into two portions, streams 35 and 36.

Stream 36, containing about 35% of the effluent from expansion machine 13, is further cooled in heat exchanger 18 by heat exchange with cold LNG flash vapor at −153° F. [−103° C.] (stream 43*b*) and cold flash vapor and liquid at −153° F. [−103° C.] (stream 45). The further cooled stream 36*a* at −140° F. [−96° C.] is thereafter supplied to distillation column 17 at a mid-column feed point. The second portion, stream 35, containing the remaining effluent from expansion machine 13, is directed to heat exchanger 15 where it is warmed to −57° F. [−49° C.] as it further cools the remaining portion (stream 31) of the cooled stream 30*a*. The further cooled stream 31*a* at −82° F. [−64° C.] is then flash expanded through an appropriate expansion device, such as expansion valve 16, to the operating pressure of fractionation tower 17, whereupon the expanded stream 31*b* at −126° F. [−88° C.] is directed to fractionation tower 17 at a lower column feed point.

Distillation column 17 serves as an LNG purification tower. It is a conventional distillation column containing a plurality of vertically spaced trays, one or more packed beds, or some combination of trays and packing. This tower recovers nearly all of the hydrocarbons heavier than methane present in its feed streams (streams 36*a* and 31*b*) as its bottom product (stream 38) so that the only significant impurity in its overhead (stream 37) is the nitrogen contained in the feed streams. Equally important, this tower also captures in its bottom product nearly all of the carbon dioxide feeding the tower, so that carbon dioxide does not enter the downstream LNG cool-down section where the extremely low temperatures would cause the formation of solid carbon dioxide, creating operating problems. Stripping vapors for the lower section of LNG purification tower 17 are provided by the vapor portion of stream 31*b*, which strips some of the methane from the liquids flowing down the column.

Reflux for distillation column 17 is created by cooling and condensing the tower overhead vapor (stream 37 at −143° F. [−97° C.]) in heat exchanger 18 by heat exchange with streams 43*b* and 45 as described previously. The condensed stream 37*a*, now at −148° F. [−100° C.], is divided into two portions. One portion (stream 40) becomes the feed to the LNG cool-down section. The other portion (stream 39) enters reflux pump 19. After pumping, stream 39*a* at −148° F. [−100° C.] is supplied to LNG purification tower 17 at a top feed point to provide the reflux liquid for the tower. This reflux liquid rectifies the vapors rising up the tower so that the tower overhead vapor (stream 37) and consequently feed stream 40 to the LNG cool-down section contain minimal amounts of carbon dioxide and hydrocarbons heavier than methane.

The feed stream for the LNG cool-down section (condensed liquid stream 40) enters heat exchanger 51 at −148° F. [−100° C.] and is subcooled by heat exchange with cold LNG flash vapor at −169° F. [−112° C.] (stream 43*a*) and cold flash vapor at −164° F. [−109° C.] (stream 41). Subcooled stream 40*a* −150° F. [−101° C.] from heat exchanger 51 is flash expanded through an appropriate expansion device, such as expansion valve 52, to a pressure of approximately 304 psia [2,096 kPa(a)]. During expansion a portion of the stream is vaporized, resulting in cooling of the total stream to −164° F. [−109° C.] (stream 40*b*). The flash expanded stream 40*b* enters separator 53 where the flash vapor (stream 41) is separated from the liquid (stream 42). The flash vapor (first flash vapor stream 41) is heated to −153° F. [−103° C.] (stream 41*a*) in heat exchanger 51 as described previously.

Liquid stream 42 from separator 53 is subcooled in heat exchanger 54 to −168° F. [−111° C.] (stream 42*a*). Subcooled stream 42*a* is flash expanded through an appropriate expansion device, such as expansion valve 55, to the LNG storage pressure (90 psia [621 kPa(a)]). During expansion a portion of the stream is vaporized, resulting in cooling of the total stream to −211° F. [−135° C.] (stream 42*b*), whereupon it is then directed to LNG storage tank 56 where the LNG flash vapor resulting from expansion (stream 43) is separated from the LNG product (stream 44). The LNG flash vapor (second flash vapor stream 43) is then heated to −169° F. [−112° C.] (stream 43*a*) as it subcools stream 42 in heat exchanger 54. Cold LNG flash vapor stream 43*a* is thereafter heated in heat exchangers 51, 18, and 10 as described previously, whereupon stream 43*d* at 95° F. [35° C.] can then be used as part of the fuel gas for the plant.

Tower bottoms stream 38 from LNG purification tower 17 is flash expanded to the pressure of cold flash vapor stream 41*a* by expansion valve 20. During expansion a portion of the stream is vaporized, resulting in cooling of the total stream from −133° F. [−92° C.] to −152° F. [−102° C.] (stream 38*a*). The flash expanded stream 38*a* is then combined with cold flash vapor stream 41*a* leaving heat exchanger 51 to form a combined flash vapor and liquid stream (stream 45) at −153° F. [−103° C.] which is supplied to heat exchanger 18. It is heated to −119° F. [−84° C.] (stream 45*a*) as it supplies cooling to expanded stream 36 and tower overhead vapor stream 37 as described previously.

The liquid (stream 34) from separator 11 is flash expanded to the pressure of stream 45*a* by expansion valve 12, cooling stream 34*a* to −102° F. [−74° C.]. The expanded stream 34*a* is combined with heated flash vapor and liquid stream 45*a* to form cool flash vapor and liquid stream 46, which is heated to 94° F. [35° C.] in heat exchanger 10 as described previously. The heated stream 46*a* is then re-compressed in two stages, compressor 23 and compressor 25 driven by supplemental power sources, with cooling to 120° F. [49° C.] between stages supplied by cooler 24, to form the compressed first residue gas (stream 46*d*).

The heated expanded vapor (stream 35*b*) at 95° F. [35° C.] from heat exchanger 10 is the second residue gas. It is re-compressed in two stages, compressor 14 driven by expansion machine 13 and compressor 22 driven by a supplemental power source, with cooling to 120° F. [49° C.] between stages supplied by cooler 21. The compressed second residue gas (stream 35*e*) combines with the compressed first residue gas (stream 46*d*) to form residue gas stream 47. After cooling to 120° F. [49° C.] in discharge cooler 26, the residue gas product (stream 47*a*) returns to the natural gas transmission pipeline at 900 psia [6,205 kPa(a)].

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | C. Dioxide | Total |
|---|---|---|---|---|---|---|
| 30 | 1,178 | 69 | 27 | 25 | 8 | 1,318 |
| 31 | 371 | 22 | 9 | 8 | 2 | 415 |
| 32 | 807 | 47 | 18 | 17 | 6 | 903 |
| 33 | 758 | 36 | 10 | 4 | 5 | 820 |
| 34 | 49 | 11 | 8 | 13 | 1 | 83 |
| 35 | 493 | 24 | 7 | 3 | 3 | 533 |
| 36 | 265 | 12 | 3 | 1 | 2 | 287 |
| 37 | 270 | 0 | 0 | 0 | 0 | 277 |
| 38 | 474 | 34 | 12 | 9 | 4 | 536 |
| 39 | 108 | 0 | 0 | 0 | 0 | 111 |
| 40 | 162 | 0 | 0 | 0 | 0 | 166 |
| 41 | 20 | 0 | 0 | 0 | 0 | 21 |
| 42 | 142 | 0 | 0 | 0 | 0 | 145 |
| 43 | 32 | 0 | 0 | 0 | 0 | 35 |
| 45 | 494 | 34 | 12 | 9 | 4 | 557 |
| 46 | 543 | 45 | 20 | 22 | 5 | 640 |
| 47 | 1,036 | 69 | 27 | 25 | 8 | 1,173 |
| 44 | 110 | 0 | 0 | 0 | 0 | 110 |

| Recoveries* | | |
|---|---|---|
| LNG | 13,389 gallons/D | [111.7 $m^3$/D] |
| | 1,781 Lbs/H | [1,781 kg/H] |
| LNG Purity | 99.35% | |
| | Power | |
| 1st Residue Gas Compression | 428 HP | [704 kW] |
| 2nd Residue Gas Compression | 145 HP | [238 kW] |
| Totals | 573 HP | [942 kW] |

*(Based on un-rounded flow rates)

The total compression power for the FIG. 1 embodiment of the present invention is 573 HP [942 kW], producing 13,389 gallons/D [111.7 $m^3$/D] of LNG. Since the density of LNG varies considerably depending on its storage conditions, it is more consistent to evaluate the power consumption per unit mass of LNG. For the FIG. 1 embodiment of the present invention, the specific power consumption is 0.322 HP-H/Lb [0.529 kW-H/kg], which is similar to that of comparable prior art processes. However, the present invention does not require carbon dioxide removal from the feed gas prior to entering the LNG production section like most prior art processes do, eliminating the capital cost and operating cost associated with constructing and operating the gas treatment processes required for such processes.

In addition, the present invention produces LNG of higher purity than most prior art processes due to the inclusion of LNG purification tower 17. The purity of the LNG is in fact limited only by the concentration of gases more volatile than methane (nitrogen, for instance) present in feed stream 30, as the operating parameters of LNG purification tower 17 can be adjusted as needed to keep the concentration of heavier hydrocarbons in the LNG product as low as desired.

Other Embodiments

Some circumstances may favor splitting the feed stream prior to cooling in heat exchanger 10. Such an embodiment of the present invention is shown in FIG. 2, where feed stream 30 is divided into two portions, streams 31 and 32, whereupon streams 31 and 32 are thereafter cooled in heat exchanger 10.

In accordance with this invention, external refrigeration may be employed to supplement the cooling available to the feed gas from other process streams, particularly in the case of a feed gas richer than that described earlier. The particular arrangement of heat exchangers for feed gas cooling must be evaluated for each particular application, as well as the choice of process streams for specific heat exchange services.

It will also be recognized that the relative amount of the feed stream 30 that is directed to the LNG cool-down section (stream 40) will depend on several factors, including feed gas pressure, feed gas composition, the amount of heat which can economically be extracted from the feed, and the quantity of horsepower available. More feed to the LNG cool-down section may increase LNG production while decreasing the purity of the LNG (stream 44) because of the corresponding decrease in reflux (stream 39) to LNG purification tower 17.

Subcooling of liquid stream 42 in heat exchanger 54 reduces the quantity of LNG flash vapor (stream 43) generated during expansion of the stream to the operating pressure of LNG storage tank 56. This generally reduces the specific power consumption for producing the LNG by keeping the flow rate of stream 43 low enough that it can be consumed as part of the plant fuel gas, eliminating any power consumption for compression of the LNG flash gas. However, some circumstances may favor elimination of heat exchanger 54 (shown dashed in FIGS. 1 and 2) due to higher plant fuel consumption than is typical, or because compression of the LNG flash gas is more economical. Similarly, elimination of the intermediate flash stage (expansion valve 52 and separator 53, and optionally heat exchanger 51, shown dashed in FIGS. 1 and 2) may be favored in some circumstances, with the resultant increase in the quantity of LNG flash vapor (stream 43) generated, which could in turn increase the specific power consumption for the process. In such cases, expanded liquid stream 38*a* is directed to heat exchanger 18 (illustrated as stream 45), stream 40*a* is directed to expansion valve 55

(illustrated as stream 42*a*), and expanded stream 42*b* is thereafter separated to produce flash vapor stream 43 and LNG product stream 44.

In FIGS. 1 and 2, multiple heat exchanger services have been shown to be combined in common heat exchangers 10, 18, and 51. It may be desirable in some instances to use individual heat exchangers for each service, or to split a heat exchange service into multiple exchangers. (The decision as to whether to combine heat exchange services or to use more than one heat exchanger for the indicated service will depend on a number of factors including, but not limited to, LNG flow rate, heat exchanger size, stream temperatures, etc.)

Although individual stream expansion is depicted in particular expansion devices, alternative expansion means may be employed where appropriate. For example, conditions may warrant work expansion of the further cooled portion of the feed stream (stream 31*a* in FIG. 1 or stream 31*b* in FIG. 2), the LNG purification tower bottoms stream (stream 38 in FIGS. 1 and 2), and/or the subcooled liquid streams in the LNG cool-down section (streams 40*a* and/or 42*a* in FIGS. 1 and 2). Further, isenthalpic flash expansion may be used in lieu of work expansion for vapor stream 33 in FIGS. 1 and 2 (with the resultant increase in the power consumption for compression of the second residue gas).

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for liquefying a portion of a natural gas stream containing methane and heavier hydrocarbon components to produce a liquefied natural gas stream wherein (a) said natural gas stream is cooled sufficiently to partially condense it and is thereafter divided into at least a first gaseous stream and a second gaseous stream;

(b) said first gaseous stream is further cooled and is thereafter expanded to an intermediate pressure, whereupon said expanded cooled first gaseous stream is supplied at a lower feed position to a distillation column that produces an overhead vapor stream and a bottom liquid stream;

(c) said second gaseous stream is separated into a vapor stream and a liquid stream;

(d) said vapor stream is expanded to said intermediate pressure and is thereafter divided into at least a first portion and a second portion;

(e) said first portion is cooled and is thereafter supplied to said distillation column at a mid-column feed position;

(f) said second portion is heated, with said heating supplying at least a portion of said cooling of one or more of said natural gas stream and said first gaseous stream;

(g) said overhead vapor stream is cooled sufficiently to at least partially condense it and form thereby a condensed stream;

(h) said condensed stream is divided into at least a feed stream and a reflux stream, whereupon said reflux stream is supplied to said distillation column at a top column feed position;

(i) said feed stream is further cooled and is thereafter expanded to lower pressure;

(j) said expanded further cooled feed stream is separated into a first flash vapor stream and a flash liquid stream;

(k) said flash liquid stream is expanded to still lower pressure;

(l) said expanded flash liquid stream is separated into a second flash vapor stream and said liquefied natural gas stream;

(m) said second flash vapor stream is heated, with said heating supplying at least a portion of said cooling of one or more of said natural gas stream, said first portion, said overhead vapor stream, and said feed stream;

(n) said first flash vapor stream is heated, with said heating supplying at least a portion of said cooling of said feed stream;

(o) said bottom liquid stream is expanded to said lower pressure, whereupon said expanded bottom liquid stream is combined with said heated first flash vapor stream to form a first combined stream;

(p) said first combined stream is heated, with said heating supplying at least a portion of said cooling of one or more of said first portion and said overhead vapor stream;

(q) said liquid stream is expanded to said lower pressure, whereupon said expanded liquid stream is combined with said heated first combined stream to form a second combined stream; and (r) said second combined stream is heated, with said heating supplying at least a portion of said cooling of said natural gas stream.

2. A process for liquefying a portion of a natural gas stream containing methane and heavier hydrocarbon components to produce a liquefied natural gas stream wherein (a) said natural gas stream is divided into at least a first gaseous stream and a second gaseous stream;

(b) said first gaseous stream is cooled and is thereafter expanded to an intermediate pressure, whereupon said expanded cooled first gaseous stream is supplied at a lower feed position to a distillation column that produces an overhead vapor stream and a bottom liquid stream;

(c) said second gaseous stream is cooled sufficiently to partially condense it and is thereafter separated into a vapor stream and a liquid stream;

(d) said vapor stream is expanded to said intermediate pressure and is thereafter divided into at least a first portion and a second portion;

(e) said first portion is cooled and is thereafter supplied to said distillation column at a mid-column feed position;

(f) said second portion is heated, with said heating supplying at least a portion of said cooling of one or more of said first gaseous stream and said second gaseous stream;

(g) said overhead vapor stream is cooled sufficiently to at least partially condense it and form thereby a condensed stream;

(h) said condensed stream is divided into at least a feed stream and a reflux stream, whereupon said reflux stream is supplied to said distillation column at a top column feed position;

(i) said feed stream is further cooled and is thereafter expanded to lower pressure;

(j) said expanded further cooled feed stream is separated into a first flash vapor stream and a flash liquid stream;

(k) said flash liquid stream is expanded to still lower pressure;

(l) said expanded flash liquid stream is separated into a second flash vapor stream and said liquefied natural gas stream;

(m) said second flash vapor stream is heated, with said heating supplying at least a portion of said cooling of one or more of said first gaseous stream, said second gaseous stream, said first portion, said overhead vapor stream, and said feed stream;

(n) said first flash vapor stream is heated, with said heating supplying at least a portion of said cooling of said feed stream;

(o) said bottom liquid stream is expanded to said lower pressure, whereupon said expanded bottom liquid stream is combined with said heated first flash vapor stream to form a first combined stream;

(p) said first combined stream is heated, with said heating supplying at least a portion of said cooling of one or more of said first portion and said overhead vapor stream;

(q) said liquid stream is expanded to said lower pressure, whereupon said expanded liquid stream is combined with said heated first combined stream to form a second combined stream; and (r) said second combined stream is heated, with said heating supplying at least a portion of said cooling of one or more of said first gaseous stream and said second gaseous stream.

3. A process for liquefying a portion of a natural gas stream containing methane and heavier hydrocarbon components to produce a liquefied natural gas stream wherein (a) said natural gas stream is cooled sufficiently to partially condense it and is thereafter divided into at least a first gaseous stream and a second gaseous stream;

(b) said first gaseous stream is further cooled and is thereafter expanded to an intermediate pressure, whereupon said expanded cooled first gaseous stream is supplied at a lower feed position to a distillation column that produces an overhead vapor stream and a bottom liquid stream;

(c) said second gaseous stream is separated into a vapor stream and a liquid stream;

(d) said vapor stream is expanded to said intermediate pressure and is thereafter divided into at least a first portion and a second portion;

(e) said first portion is cooled and is thereafter supplied to said distillation column at a mid-column feed position;

(f) said second portion is heated, with said heating supplying at least a portion of said cooling of one or more of said natural gas stream and said first gaseous stream;

(g) said overhead vapor stream is cooled sufficiently to at least partially condense it and form thereby a condensed stream;

(h) said condensed stream is divided into at least a feed stream and a reflux stream, whereupon said reflux stream is supplied to said distillation column at a top column feed position;

(i) said bottom liquid stream is expanded to lower pressure, whereupon said expanded bottom liquid stream is heated, with said heating supplying at least a portion of said cooling of one or more of said first portion and said overhead vapor stream;

(j) said feed stream is expanded to still lower pressure;

(k) said expanded feed stream is separated into a flash vapor stream and said liquefied natural gas stream;

(l) said flash vapor stream is heated, with said heating supplying at least a portion of said cooling of one or more of said natural gas stream, said first portion, and said overhead vapor stream;

(m) said liquid stream is expanded to said lower pressure, whereupon said expanded liquid stream is combined with said heated expanded bottom liquid stream to form a combined stream; and (n) said combined stream is heated, with said heating supplying at least a portion of said cooling of said natural gas stream.

4. A process for liquefying a portion of a natural gas stream containing methane and heavier hydrocarbon components to produce a liquefied natural gas stream wherein (a) said natural gas stream is divided into at least a first gaseous stream and a second gaseous stream;

(b) said first gaseous stream is cooled and is thereafter expanded to an intermediate pressure, whereupon said expanded cooled first gaseous stream is supplied at a lower feed position to a distillation column that produces an overhead vapor stream and a bottom liquid stream;

(c) said second gaseous stream is cooled sufficiently to partially condense it and is thereafter separated into a vapor stream and a liquid stream;

(d) said vapor stream is expanded to said intermediate pressure and is thereafter divided into at least a first portion and a second portion;

(e) said first portion is cooled and is thereafter supplied to said distillation column at a mid-column feed position;

(f) said second portion is heated, with said heating supplying at least a portion of said cooling of one or more of said first gaseous stream and said second gaseous stream;

(g) said overhead vapor stream is cooled sufficiently to at least partially condense it and form thereby a condensed stream;

(h) said condensed stream is divided into at least a feed stream and a reflux stream, whereupon said reflux stream is supplied to said distillation column at a top column feed position;

(i) said bottom liquid stream is expanded to lower pressure, whereupon said expanded bottom liquid stream is heated, with said heating supplying at least a portion of said cooling of one or more of said first portion and said overhead vapor stream;

(j) said feed stream is expanded to still lower pressure;

(k) said expanded feed stream is separated into a flash vapor stream and said liquefied natural gas stream;

(l) said flash vapor stream is heated, with said heating supplying at least a portion of said cooling of one or more of said first gaseous stream, said second gaseous stream, said first portion, and said overhead vapor stream;

(m) said liquid stream is expanded to said lower pressure, whereupon said expanded liquid stream is combined with said heated expanded bottom liquid stream to form a combined stream; and (n) said combined stream is heated, with said heating supplying at least a portion of said cooling of one or more of said first gaseous stream and said second gaseous stream.

5. The process according to claim 1 or 2 wherein (a) said flash liquid stream is cooled before it is expanded to said still lower pressure; and (b) said heating of said second flash vapor stream also supplies at least a portion of said cooling of said flash liquid stream.

6. The process according to claim 3 or 4 wherein (a) said feed is cooled before it is expanded to said still lower pressure; and (b) said heating of said flash vapor stream also supplies at least a portion of said cooling of said feed stream.

7. An apparatus for liquefying a portion of a natural gas stream containing methane and heavier hydrocarbon components to produce a liquefied natural gas stream comprising (a) first heat exchange means connected to receive said natural gas stream and cool it sufficiently to partially condense it;

(b) first dividing means connected to receive said partially condensed natural gas stream and divide it into at least a first gaseous stream and a second gaseous stream;

(c) second heat exchange means connected to said first dividing means to receive said first gaseous stream and further cool it;

(d) first expansion means connected to said second heat exchange means to receive said further cooled first gaseous stream and expand it to an intermediate pressure, said first expansion means being further connected to a distillation column to supply said expanded further cooled first gaseous stream at a lower feed position;

(e) first separation means connected to said first dividing means to receive said second gaseous stream and separate it into a vapor stream and a liquid stream;

(f) second expansion means connected to said first separation means to receive said vapor stream and expand it to said intermediate pressure;

(g) second dividing means connected to said second expansion means to receive said expanded vapor stream and divide it into at least a first portion and a second portion;

(h) third heat exchange means connected to said second dividing means to receive said first portion and cool it, said heat exchange means being further connected to said distillation column to supply said cooled first portion at a mid-column feed position;

(i) said second heat exchange means further connected to said second dividing means to receive said second portion and heat it, with said heating supplying at least a portion of said further cooling of said first gaseous stream;

(j) first withdrawing means connected to an upper region of said distillation column to withdraw an overhead vapor stream;

(k) said third heat exchange means further connected to said first withdrawing means to receive said overhead vapor stream and cool it sufficiently to at least partially condense it and form thereby a condensed stream;

(l) third dividing means connected to said third heat exchange means to receive said condensed stream and divide it into at least a feed stream and a reflux stream, said third dividing means being further connected to said distillation column to supply said reflux stream to said distillation column at a top column feed position;

(m) fourth heat exchange means connected to said third dividing means to receive said feed stream and further cool it;

(n) third expansion means connected to said fourth heat exchange means to receive said further cooled feed stream and expand it to lower pressure;

(o) second separation means connected to said third expansion means to receive said expanded further cooled feed stream and separate it into a first flash vapor stream and a flash liquid stream;

(p) fourth expansion means connected to said second separation means to receive said flash liquid stream and expand it to still lower pressure;

(q) third separation means connected to said fourth expansion means to receive said expanded flash liquid stream and separate it into a second flash vapor stream and said liquefied natural gas stream;

(r) said fourth heat exchange means further connected to said third separation means to receive said second flash vapor stream and heat it, with said heating supplying at least a portion of said further cooling of said feed stream;

(s) said fourth heat exchange means further connected to said second separation means to receive said first flash vapor stream and heat it, with said heating supplying at least a portion of said further cooling of said feed stream;

(t) second withdrawing means connected to a lower region of said distillation column to withdraw a bottom liquid stream;

(u) fifth expansion means connected to said second withdrawing means to receive said bottom liquid stream and expand it to said lower pressure;

(v) first combining means connected to said fifth expansion means and to said fourth heat exchange means to receive said expanded bottom liquid stream and said heated first flash vapor stream, respectively, and form thereby a first combined stream;

(w) said third heat exchange means further connected to said first combining means to receive said first combined stream and heat it, with said heating supplying at least a portion of said cooling of one or more of said first portion and said overhead vapor stream;

(x) sixth expansion means connected to said first separation means to receive said liquid stream and expand it to said lower pressure;

(y) second combining means connected to said sixth expansion means and to said third heat exchange means to receive said expanded liquid stream and said heated first combined stream, respectively, and form thereby a second combined stream; and (z) said first heat exchange means further connected to said second combining means to receive said second combined stream and heat it, with said heating supplying at least a portion of said cooling of said natural gas stream.

8. An apparatus for liquefying a portion of a natural gas stream containing methane and heavier hydrocarbon components to produce a liquefied natural gas stream comprising (a) first dividing means connected to receive said natural gas stream and divide it into at least a first gaseous stream and a second gaseous stream;

(b) first heat exchange means connected to receive said first gaseous stream and cool it;

(c) second heat exchange means connected to said first heat exchange means to receive said cooled first gaseous stream and further cool it;

(d) first expansion means connected to said second heat exchange means to receive said further cooled first gaseous stream and expand it to an intermediate pressure, said first expansion means being further connected to a distillation column to supply said expanded further cooled first gaseous stream at a lower feed position;

(e) said first heat exchange means further connected to receive said second gaseous stream and cool it sufficiently to partially condense it;

(f) first separation means connected to said first heat exchange means to receive said partially condensed second gaseous stream and separate it into a vapor stream and a liquid stream;

(g) second expansion means connected to said first separation means to receive said vapor stream and expand it to said intermediate pressure;

(h) second dividing means connected to said second expansion means to receive said expanded vapor stream and divide it into at least a first portion and a second portion;

(i) third heat exchange means connected to said second dividing means to receive said first portion and cool it, said heat exchange means being further connected to said distillation column to supply said cooled first portion at a mid-column feed position;

(j) said second heat exchange means further connected to said second dividing means to receive said second portion and heat it, with said heating supplying at least a portion of said further cooling of said cooled first gaseous stream;

(k) first withdrawing means connected to an upper region of said distillation column to withdraw an overhead vapor stream;

(l) said third heat exchange means further connected to said first withdrawing means to receive said overhead vapor stream and cool it sufficiently to at least partially condense it and form thereby a condensed stream;

(m) third dividing means connected to said third heat exchange means to receive said condensed stream and divide it into at least a feed stream and a reflux stream, said third dividing means being further connected to said distillation column to supply said reflux stream to said distillation column at a top column feed position;

(n) fourth heat exchange means connected to said third dividing means to receive said feed stream and further cool it;

(o) third expansion means connected to said fourth heat exchange means to receive said further cooled feed stream and expand it to lower pressure;

(p) second separation means connected to said third expansion means to receive said expanded further cooled feed stream and separate it into a first flash vapor stream and a flash liquid stream;

(q) fourth expansion means connected to said second separation means to receive said flash liquid stream and expand it to still lower pressure;

(r) third separation means connected to said fourth expansion means to receive said expanded flash liquid stream and separate it into a second flash vapor stream and said liquefied natural gas stream;

(s) said fourth heat exchange means further connected to said third separation means to receive said second flash vapor stream and heat it, with said heating supplying at least a portion of said further cooling of said feed stream;

(t) said fourth heat exchange means further connected to said second separation means to receive said first flash vapor stream and heat it, with said heating supplying at least a portion of said further cooling of said feed stream;

(u) second withdrawing means connected to a lower region of said distillation column to withdraw a bottom liquid stream;

(v) fifth expansion means connected to said second withdrawing means to receive said bottom liquid stream and expand it to said lower pressure;

(w) first combining means connected to said fifth expansion means and to said fourth heat exchange means to receive said expanded bottom liquid stream and said heated first flash vapor stream, respectively, and form thereby a first combined stream;

(x) said third heat exchange means further connected to said first combining means to receive said first combined stream and heat it, with said heating supplying at least a portion of said cooling of one or more of said first portion and said overhead vapor stream;

(y) sixth expansion means connected to said first separation means to receive said liquid stream and expand it to said lower pressure;

(z) second combining means connected to said sixth expansion means and to said third heat exchange means to receive said expanded liquid stream and said heated first combined stream, respectively, and form thereby a second combined stream; and (aa) said first heat exchange means further connected to said second combining means to receive said second combined stream and heat it, with said heating supplying at least a portion of said cooling of one or more of said first gaseous stream and said second gaseous stream.

9. An apparatus for liquefying a portion of a natural gas stream containing methane and heavier hydrocarbon components to produce a liquefied natural gas stream comprising (a) first heat exchange means connected to receive said natural gas stream and cool it sufficiently to partially condense it;

(b) first dividing means connected to receive said partially condensed natural gas stream and divide it into at least a first gaseous stream and a second gaseous stream;

(c) second heat exchange means connected to said first dividing means to receive said first gaseous stream and further cool it;

(d) first expansion means connected to said second heat exchange means to receive said further cooled first gaseous stream and expand it to an intermediate pressure, said first expansion means being further connected to a distillation column to supply said expanded further cooled first gaseous stream at a lower feed position;

(e) first separation means connected to said first dividing means to receive said second gaseous stream and separate it into a vapor stream and a liquid stream;

(f) second expansion means connected to said first separation means to receive said vapor stream and expand it to said intermediate pressure;

(g) second dividing means connected to said second expansion means to receive said expanded vapor stream and divide it into at least a first portion and a second portion;

(h) third heat exchange means connected to said second dividing means to receive said first portion and cool it, said heat exchange means being further connected to said distillation column to supply said cooled first portion at a mid-column feed position;

(i) said second heat exchange means further connected to said second dividing means to receive said second portion and heat it, with said heating supplying at least a portion of said further cooling of said first gaseous stream;

(j) first withdrawing means connected to an upper region of said distillation column to withdraw an overhead vapor stream;

(k) said third heat exchange means further connected to said first withdrawing means to receive said overhead vapor stream and cool it sufficiently to at least partially condense it and form thereby a condensed stream;

(l) third dividing means connected to said third heat exchange means to receive said condensed stream and divide it into at least a feed stream and a reflux stream, said third dividing means being further connected to said distillation column to supply said reflux stream to said distillation column at a top column feed position;

(m) second withdrawing means connected to a lower region of said distillation column to withdraw a bottom liquid stream;

(n) third expansion means connected to said second withdrawing means to receive said bottom liquid stream and expand it to lower pressure;

(o) said third heat exchange means further connected to said third expansion means to receive said expanded bottom liquid stream and heat it, with said heating supplying at least a portion of said cooling of one or more of said first portion and said overhead vapor stream;

(p) fourth expansion means connected to said third dividing means to receive said feed stream and expand it to still lower pressure;

(q) second separation means connected to said fourth expansion means to receive said expanded feed stream and separate it into a flash vapor stream and said liquefied natural gas stream;

(r) said third heat exchange means further connected to said second separation means to receive said flash vapor stream and heat it, with said heating supplying at least a portion of said cooling of one or more of said first portion and said overhead vapor stream;

(s) fifth expansion means connected to said first separation means to receive said liquid stream and expand it to said lower pressure;

(t) combining means connected to said fifth expansion means and to said third heat exchange means to receive said expanded liquid stream and said heated expanded bottom liquid stream, respectively, and form thereby a combined stream; and (u) said first heat exchange means further connected to said combining means to receive said combined stream and heat it, with said heating supplying at least a portion of said cooling of said natural gas stream.

10. An apparatus for liquefying a portion of a natural gas stream containing methane and heavier hydrocarbon components to produce a liquefied natural gas stream comprising (a) first dividing means connected to receive said natural gas stream and divide it into at least a first gaseous stream and a second gaseous stream;

(b) first heat exchange means connected to receive said first gaseous stream and cool it;

(c) second heat exchange means connected to said first heat exchange means to receive said cooled first gaseous stream and further cool it;

(d) first expansion means connected to said second heat exchange means to receive said further cooled first gaseous stream and expand it to an intermediate pressure, said first expansion means being further connected to a distillation column to supply said expanded further cooled first gaseous stream at a lower feed position;

(e) said first heat exchange means further connected to receive said second gaseous stream and cool it sufficiently to partially condense it;

(f) first separation means connected to said first heat exchange means to receive said partially condensed second gaseous stream and separate it into a vapor stream and a liquid stream;

(g) second expansion means connected to said first separation means to receive said vapor stream and expand it to said intermediate pressure;

(h) second dividing means connected to said second expansion means to receive said expanded vapor stream and divide it into at least a first portion and a second portion;

(i) third heat exchange means connected to said second dividing means to receive said first portion and cool it, said heat exchange means being further connected to said distillation column to supply said cooled first portion at a mid-column feed position;

(j) said second heat exchange means further connected to said second dividing means to receive said second portion and heat it, with said heating supplying at least a portion of said further cooling of said cooled first gaseous stream;

(k) first withdrawing means connected to an upper region of said distillation column to withdraw an overhead vapor stream;

(l) said third heat exchange means further connected to said first withdrawing means to receive said overhead vapor stream and cool it sufficiently to at least partially condense it and form thereby a condensed stream;

(m) third dividing means connected to said third heat exchange means to receive said condensed stream and divide it into at least a feed stream and a reflux stream, said third dividing means being further connected to said distillation column to supply said reflux stream to said distillation column at a top column feed position;

(n) second withdrawing means connected to a lower region of said distillation column to withdraw a bottom liquid stream;

(o) third expansion means connected to said second withdrawing means to receive said bottom liquid stream and expand it to lower pressure;

(p) said third heat exchange means further connected to said third expansion means to receive said expanded bottom liquid stream and heat it, with said heating supplying at least a portion of said cooling of one or more of said first portion and said overhead vapor stream;

(q) fourth expansion means connected to said third dividing means to receive said feed stream and expand it to still lower pressure;

(r) second separation means connected to said fourth expansion means to receive said expanded feed stream and separate it into a flash vapor stream and said liquefied natural gas stream;

(s) said third heat exchange means further connected to said second separation means to receive said flash vapor stream and heat it, with said heating supplying at least a portion of said cooling of one or more of said first portion and said overhead vapor stream;

(t) fifth expansion means connected to said first separation means to receive said liquid stream and expand it to said lower pressure;

(u) combining means connected to said fifth expansion means and to said third heat exchange means to receive said expanded liquid stream and said heated expanded bottom liquid stream, respectively, and form thereby a combined stream; and (v) said first heat exchange means further connected to said combining means to receive said combined stream and heat it, with said heating supplying at least a portion of said cooling of one or more of said first gaseous stream and said second gaseous stream.

11. The apparatus according to claim 7 or 8 wherein (a) a fifth heat exchange means is connected to said second separation means to receive said flash liquid stream and cool it;

(b) said fourth expansion means is adapted to be connected to said fifth heat exchange means to receive said cooled flash liquid stream and expand it to said still lower pressure;

(c) said third separation means is adapted to separate said expanded cooled flash liquid stream into said second flash vapor stream and said liquefied natural gas stream;

(d) said fifth heat exchange means is further connected to said third separation means to receive said second flash vapor stream and heat it, with said heating supplying at least a portion of said cooling of said flash liquid stream; and (e) said fourth heat exchange means is adapted to be connected to said fifth heat exchange means to receive said heated second flash vapor stream and further heat it, with said further heating supplying at least a portion of said further cooling of said feed stream.

12. The apparatus according to claim 9 or 10 wherein (a) a fourth heat exchange means is connected to said third dividing means to receive said feed stream and further cool it;

(b) said fourth expansion means is adapted to be connected to said fourth heat exchange means to receive said further cooled feed stream and expand it to said still lower pressure;

(c) said second separation means is adapted to separate said expanded further cooled feed stream into said flash vapor stream and said liquefied natural gas stream;

(d) said fourth heat exchange means is further connected to said second separation means to receive said flash vapor stream and heat it, with said heating supplying at least a portion of said further cooling of said feed stream; and (e) said third heat exchange means is adapted to be connected to said fourth heat exchange means to receive said heated flash vapor stream and further heat it, with said further heating supplying at least a portion of said cooling of one or more of said first portion and said overhead vapor stream.

* * * * *